US011027804B2

(12) United States Patent
Okaya et al.

(10) Patent No.: US 11,027,804 B2
(45) Date of Patent: Jun. 8, 2021

(54) UNDERWATER SAILING BODY AND METHOD OF CONTROLLING POSTURE OF UNDERWATER SAILING BODY

(71) Applicant: KAWASAKI JUKOGYO KABUSHIKI KAISHA, Kobe (JP)

(72) Inventors: Noriyuki Okaya, Kobe (JP); Takashi Okada, Kobe (JP); Takafumi Okamoto, Kobe (JP); Hiroaki Kagaya, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 79 days.

(21) Appl. No.: 16/336,817

(22) PCT Filed: Sep. 8, 2017

(86) PCT No.: PCT/JP2017/032473
§ 371 (c)(1),
(2) Date: Mar. 26, 2019

(87) PCT Pub. No.: WO2018/056079
PCT Pub. Date: Mar. 29, 2018

(65) Prior Publication Data

US 2020/0247514 A1 Aug. 6, 2020

(30) Foreign Application Priority Data

Sep. 26, 2016 (JP) ..... JP2016-186997

(51) Int. Cl.
*B63G 8/08* (2006.01)
*B63G 8/00* (2006.01)
(Continued)

(52) U.S. Cl.
CPC ..... *B63G 8/001* (2013.01); *B63G 8/16* (2013.01); *B63G 2008/004* (2013.01); *B63H 25/42* (2013.01)

(58) Field of Classification Search
CPC ..... B63H 25/04; B63G 8/16; B63G 2008/004
See application file for complete search history.

(56) References Cited

U.S. PATENT DOCUMENTS

2011/0094433 A1 4/2011 Shoda et al.
2012/0130570 A1* 5/2012 Pease ..... B63H 25/04 701/21
(Continued)

FOREIGN PATENT DOCUMENTS

JP S61-267461 A 11/1986
JP H02-216389 A 8/1990
(Continued)

*Primary Examiner* — Andrew Polay
(74) *Attorney, Agent, or Firm* — Oliff PLC

(57) ABSTRACT

An underwater sailing body includes: a positioning device configured to detect positional information of a hull of the underwater sailing body; a posture detecting sensor configured to detect posture information of the hull; an actuator configured to apply thrust to the hull in a front-rear direction of the hull, a left-right direction of the hull, an upper-lower direction of the hull in water to change the position and posture of the hull; and a controller configured to control the actuator. In order to hold a hull at a target position when the hull receives an external force by disturbances, the hull keeps balance by using thrusters with respect to the external force acting on the hull. Specifically, the hull is held at the target position by controlling a thruster configured to generate thrust in a front-rear direction and a thruster configured to generate thrust in a left-right direction.

3 Claims, 8 Drawing Sheets

(51) Int. Cl.
*B63G 8/16* (2006.01)
*B63H 25/42* (2006.01)

(56) References Cited

U.S. PATENT DOCUMENTS

| | | | | |
|---|---|---|---|---|
| 2014/0140170 | A1* | 5/2014 | Brizard | G01V 1/3852 367/16 |
| 2016/0304172 | A1* | 10/2016 | Combee | G05D 1/0206 |

FOREIGN PATENT DOCUMENTS

| | | | |
|---|---|---|---|
| JP | 2000-302098 | A | 10/2000 |
| JP | 2006-160025 | A | 6/2006 |
| JP | 2007-132769 | A | 5/2007 |
| JP | 2007-160972 | A | 6/2007 |
| JP | 2014-210551 | A | 11/2014 |
| WO | 2009/154006 | A1 | 12/2009 |

* cited by examiner

UNDERWATER SAILING BODY AND METHOD OF CONTROLLING POSTURE OF UNDERWATER SAILING BODY

TECHNICAL FIELD

The present invention relates to an underwater sailing body and a method of controlling a posture of the underwater sailing body.

BACKGROUND ART

To hold a hull at a target position when the hull receives an external force by disturbances, such as waves and ocean currents, the hull needs to keep balance by using thrusters with respect to the external force acting on the hull. Specifically, the hull is held at the target position by controlling a thruster configured to generate thrust in a front-rear direction and a thruster configured to generate thrust in a left-right direction.

However, in some cases, the hull cannot receive electric power supply at sea. Therefore, it is desired to suppress the amount of electric power consumed, for example, when the thrusters are driven to hold the hull at the target position. For example, proposed as a technique of holding a hull at a target position while suppressing electric power consumption is an automatic direction setting method in which: a bow of a ship is directed in a direction of a resultant force of disturbances (hereinafter referred to as a "direction in which an external force acts"); and the ship is held at a target position (PTL 1). According to the automatic direction setting method of PTL 1, the electric power consumption necessary to hold the hull at the target position can be suppressed by directing the bow in the direction in which the external force acts.

CITATION LIST

Patent Literature

PTL 1: Japanese Laid-Open Patent Application Publication No. 2000-302098

SUMMARY OF INVENTION

Technical Problem

According to the automatic direction setting method of PTL 1, when holding the hull at the target position, the electric power consumption can be suppressed by directing the bow in the direction in which the external force acts. However, although the automatic direction setting method of PTL 1 considers the control of the position and posture of the ship on a horizontal plane, it does not consider a case where as in an underwater sailing body, such as an AUV (autonomous underwater vehicle), the external force is applied to the hull not only in a left-right direction but also in an upper-lower direction.

The present invention was made to solve the above problem, and an object of the present invention is to provide an underwater sailing body and a method of controlling a posture of the underwater sailing body, each of which can hold a hull at a target position while suppressing electric power consumption.

Solution to Problem

An underwater sailing body according to an aspect of the present invention includes: a positioning device configured to detect positional information indicating a position of a hull of the underwater sailing body; a posture detecting sensor configured to detect posture information indicating a posture of the hull; an actuator configured to apply thrust to the hull in a front-rear direction of the hull, a left-right direction of the hull, and an upper-lower direction of the hull in water to change the position and posture of the hull; and a controller configured to control the actuator, wherein: in order to hold the hull at a target position based on the positional information detected by the positioning device, the controller calculates a controlling force in the front-rear direction of the hull, a controlling force in the left-right direction of the hull, a controlling force in the upper-lower direction of the hull, a turn controlling force of turning the hull in a roll direction of the hull, a turn controlling force of turning the hull in a yaw direction of the hull, and a turn controlling force of turning the hull in a pitch direction of the hull, and controls the actuator based on the calculated forces; and when an external force is applied to the hull held at the target position, the controller updates target posture information such that each of the controlling force in the left-right direction and the controlling force in the upper-lower direction becomes zero, and controls the actuator such that the posture of the hull is changed to a posture corresponding to the updated posture information based on the posture information detected by the posture detecting sensor.

The front-rear direction denotes a direction from a stern of the hull to a bow of the hull or from the bow to the stern. The left-right direction denotes a direction from port of the hull to starboard of the hull or from the starboard to the port. The upper-lower direction denotes a direction from a bottom surface of the hull to an upper surface of the hull or from the upper surface to the bottom surface.

According to the above configuration, when the external force is applied to the hull held at the target position, the controller can change the posture of the hull by controlling the actuator such that each of the controlling force in the left-right direction and the controlling force in the upper-lower direction becomes zero. The posture by which each of the controlling force in the left-right direction and the controlling force in the upper-lower direction becomes zero denotes the posture in which the bow is directed in the direction in which the external force acts. Typically, the hull is designed such that fluid resistance becomes low when the hull advances. Therefore, the posture in which the bow is directed in the direction in which the external force acts denotes the posture by which a fluid force acting on the hull is reduced.

As above, even when the external force is applied to the hull, the underwater sailing body can take the posture by which the fluid force acting on the hull is reduced. Therefore, the amount of electric power consumed by the actuator driven to hold the hull at the target position can be reduced.

Thus, the underwater sailing body according to the above aspect of the present invention has an effect of being able to hold the hull at the target position while suppressing the electric power consumption.

The underwater sailing body according to another aspect of the present invention may be configured such that: the controller includes a controlling force calculating portion configured to calculate the controlling force in the front-rear direction, the controlling force in the left-right direction, the controlling force in the upper-lower direction, the turn controlling force in the roll direction, the turn controlling force in the yaw direction, and the turn controlling force in the pitch direction from a difference between target positional information and the positional information detected by the positioning device and a difference between the target posture information and the posture information detected by the posture detecting sensor; and when the external force is applied to the hull held at the target position, the controller updates a command value of a yaw angle of the target posture information and a command value of a pitch angle of the target posture information such that each of the controlling force in the left-right direction and the controlling force in the upper-lower direction, which are calculated by the controlling force calculating portion, becomes zero.

According to the above configuration, the controller can update the command value of the yaw angle and the command value of the pitch angle. Therefore, even when the external force is applied to the hull, the hull can turn in the yaw direction and the pitch direction to take the posture by which each of the controlling force in the left-right direction and the controlling force in the upper-lower direction becomes zero, i.e., the posture by which the fluid force acting on the hull is reduced.

The underwater sailing body according to yet another aspect of the present invention may further include a flow direction meter configured to measure a tidal current incoming direction that is a direction of the external force applied to the hull, wherein the controller may update the command value of the yaw angle and the command value of the pitch angle based on the target posture information indicating the posture of the hull in which the bow is directed in the tidal current incoming direction measured by the flow direction meter.

According to the above configuration, since the flow direction meter is included, the tidal current incoming direction, i.e., the direction of the external force applied to the hull can be recognized. Therefore, based on the measurement result of the flow direction meter, the controller can recognize the posture by which each of the controlling force in the left-right direction and the controlling force in the upper-lower direction becomes zero, i.e., the posture by which the fluid force acting on the hull is reduced, and can update the command value of the yaw angle and the command value of the pitch angle such that the hull takes the above posture.

The underwater sailing body according to still another aspect of the present invention may be configured such that: the controller includes a first change rate limiter configured to limit a change amount of the turn controlling force in the pitch direction, the change amount being calculated from a difference between the updated command value of the pitch angle and a value of the pitch angle of the posture information detected by the posture detecting sensor and a second change rate limiter configured to limit a change amount of the turn controlling force in the yaw direction, the change amount being calculated from a difference between the updated command value of the yaw angle and a value of the yaw angle of the posture information detected by the posture detecting sensor; and the controller changes setting of the change amount of the first change rate limiter and setting of the change amount of the second change rate limiter and updates the command value of the yaw angle and the command value of the pitch angle in this order, or the controller sets a speed of updating the command value of the pitch angle to be lower than a speed of updating the command value of the yaw angle.

According to the above configuration, since the controller includes the first change rate limiter and the second change rate limiter, it is possible to prevent a case where: the change amount of the turn controlling force in the pitch direction and the change amount of the turn controlling force in the yaw direction become large; the hull largely turns in the pitch direction and the yaw direction to drastically change the posture.

Further, the controller can change the setting of the first change rate limiter and the setting of the second change rate limiter and update the command value of the yaw angle and the command value of the pitch angle in this order. Or, the controller can set the speed of updating the command value of the yaw angle to be higher than the speed of updating the command value of the pitch angle. Therefore, the turn in the yaw direction can be performed preferentially over the turn in the pitch direction. On this account, it is possible to prevent a case where, for example, when the hull changes the posture to deal with the external force applied from a rear and diagonally-upper side of the hull, the pitch angle exceeds 90°, and the hull takes an abnormal posture in which the upper surface and bottom surface of the hull are reversed.

The underwater sailing body according to yet another aspect of the present invention may be configured such that: the controller includes a yaw angle command value calculating portion configured to integrate a value of the controlling force in the left-right direction to calculate a target command value of the yaw angle and a pitch angle command value calculating portion configured to integrate a value of the controlling force in the upper-lower direction to calculate a target command value of the pitch angle; and until each of the controlling force in the left-right direction and the controlling force in the upper-lower direction becomes zero, the controller updates the command value of the yaw angle and the command value of the pitch angle by the command value calculated by the yaw angle command value calculating portion and the command value calculated by the pitch angle command value calculating portion.

According to the above configuration, since the controller includes the yaw angle command value calculating portion and the pitch angle command value calculating portion, the controller can update the command value of the yaw angle and the command value of the pitch angle to change the posture of the hull to the posture by which each of the controlling force in the left-right direction and the controlling force in the upper-lower direction becomes zero.

Therefore, even when the controller does not include the flow direction meter, the controller can change the posture of the hull to the posture by which each of the controlling force in the left-right direction and the controlling force in the upper-lower direction becomes zero, i.e., the posture by which the fluid force acting on the hull is reduced.

The underwater sailing body according to still another aspect of the present invention may be configured such that: the yaw angle command value calculating portion calculates the target command value of the yaw angle from a value obtained by integrating a value obtained by multiplying the value of the controlling force in the left-right direction by a gain; the pitch angle command value calculating portion calculates the target command value of the pitch angle from a value obtained by integrating a value obtained by multiplying the value of the controlling force in the upper-lower direction by a gain; and the controller changes a value of the gain by which the yaw angle command value calculating portion multiplies the value of the controlling force in the left-right direction and a value of the gain by which the pitch angle command value calculating portion multiplies the value of the controlling force in the upper-lower direction, and updates the command value of the yaw angle and the command value of the pitch angle in this order, or the controller sets a speed of updating the command value of the pitch angle to be lower than a speed of updating the command value of the yaw angle.

According to the above configuration, the yaw angle command value calculating portion calculates the target command value of the yaw angle from the value obtained by integrating the value obtained by multiplying the value of the controlling force in the left-right direction by the gain, and the pitch angle command value calculating portion calculates the target command value of the pitch angle from the value obtained by integrating the value obtained by multiplying the value of the controlling force in the upper-lower direction by the gain. Therefore, the controller can change the settings of the values of the above gains and update the command value of the yaw angle and the command value of the pitch angle in this order. Or, the controller can set the speed of updating the command value of the yaw angle to be higher than the speed of updating the command value of the pitch angle.

Therefore, the turn in the yaw direction can be performed preferentially over the turn in the pitch direction. On this account, it is possible to prevent a case where, for example, when the hull changes the posture to deal with the external force applied from a rear and diagonally-upper side of the hull, the pitch angle exceeds 90°, and the hull takes the abnormal posture in which the upper surface and bottom surface of the hull are reversed.

The underwater sailing body according to yet another aspect of the present invention may be configured such that the actuator includes a gravity center position changing portion configured to move in the front-rear direction in the hull so as to change a gravity center position of the hull.

According to above configuration, since the gravity center position changing portion is included, the gravity center position of the hull can be changed in the front-rear direction. Therefore, a rotational direction of pitching of the hull can be easily determined, and therefore, the control of the turn in the pitch direction can be facilitated.

A method of controlling a posture of an underwater sailing body according to an aspect of the present invention is a method of controlling a posture of an underwater sailing body, the underwater sailing body including: a positioning device configured to detect positional information indicating a position of a hull of the underwater sailing body; a posture detecting sensor configured to detect posture information indicating a posture of the hull; an actuator configured to apply thrust to the hull in a front-rear direction of the hull, a left-right direction of the hull, and an upper-lower direction of the hull in water to change the position and posture of the hull; and a controller configured to control the actuator, the method including: in order to hold the hull at a target position based on the positional information detected by the positioning device, calculating by the controller a controlling force in the front-rear direction of the hull, a controlling force in the left-right direction of the hull, a controlling force in the upper-lower direction of the hull, a turn controlling force of turning the hull in a roll direction of the hull, a turn controlling force of turning the hull in a yaw direction of the hull, and a turn controlling force of turning the hull in a pitch direction of the hull, and controlling the actuator by the controller based on the calculated forces; and when an external force is applied to the hull held at the target position, updating, by the controller, target posture information such that each of the controlling force in the left-right direction and the controlling force in the upper-lower direction becomes zero, and controlling the actuator by the controller such that the posture of the hull is changed to a posture corresponding to the updated posture information based on the posture information detected by the posture detecting sensor.

According to the above method, when the external force is applied to the hull held at the target position, the controller can control the actuator to change the posture of the hull such that each of the controlling force in the left-right direction and the controlling force in the upper-lower direction becomes zero. The posture by which each of the controlling force in the left-right direction and the controlling force in the upper-lower direction becomes zero denotes the posture in which the bow is directed in the direction in which the external force acts, i.e., the posture by which the fluid force acting on the hull is reduced.

As above, even when the external force is applied to the hull, the hull can take the posture by which the fluid force acting on the hull is reduced. Therefore, the amount of electric power consumed by the actuator driven to hold the hull at the target position can be reduced.

Therefore, the method of controlling the posture of the underwater sailing body according to the aspect of the present invention has an effect of being able to hold the hull at the target position while suppressing the electric power consumption.

Advantageous Effects of Invention

The present invention is configured as explained above, and each of the underwater sailing body according to the present invention and the method of controlling the posture of the underwater sailing body according to the present invention has the effect of being able to hold the hull at the target position while suppressing the electric power consumption.

BRIEF DESCRIPTION OF DRAWINGS

FIG. 1A is a top view (plan view) of the underwater sailing body. FIG. 1B is a side view of the underwater sailing body.

FIG. 3A shows one example of the posture of the underwater sailing body when disturbances occur. FIG. 3B shows one example of the posture of the underwater sailing body which posture is changed in accordance with the occurrence of the disturbances.

FIG. 4A shows one example of the posture of the underwater sailing body when disturbances occur. FIG. 4B shows one example of the posture of the underwater sailing body which posture is changed in accordance with the occurrence of the disturbances.

DESCRIPTION OF EMBODIMENTS

Hereinafter, embodiments of the present invention will be explained with reference to the drawings. The present description explains an example in which an underwater sailing body 1 according to the present invention is a submersible vessel, such as an AUV. However, the underwater sailing body 1 of the present invention is not limited to this and is only required to be an underwater sailing body that is held at a target position in water and performs work, for example.

Embodiment 1

Figure 1A:
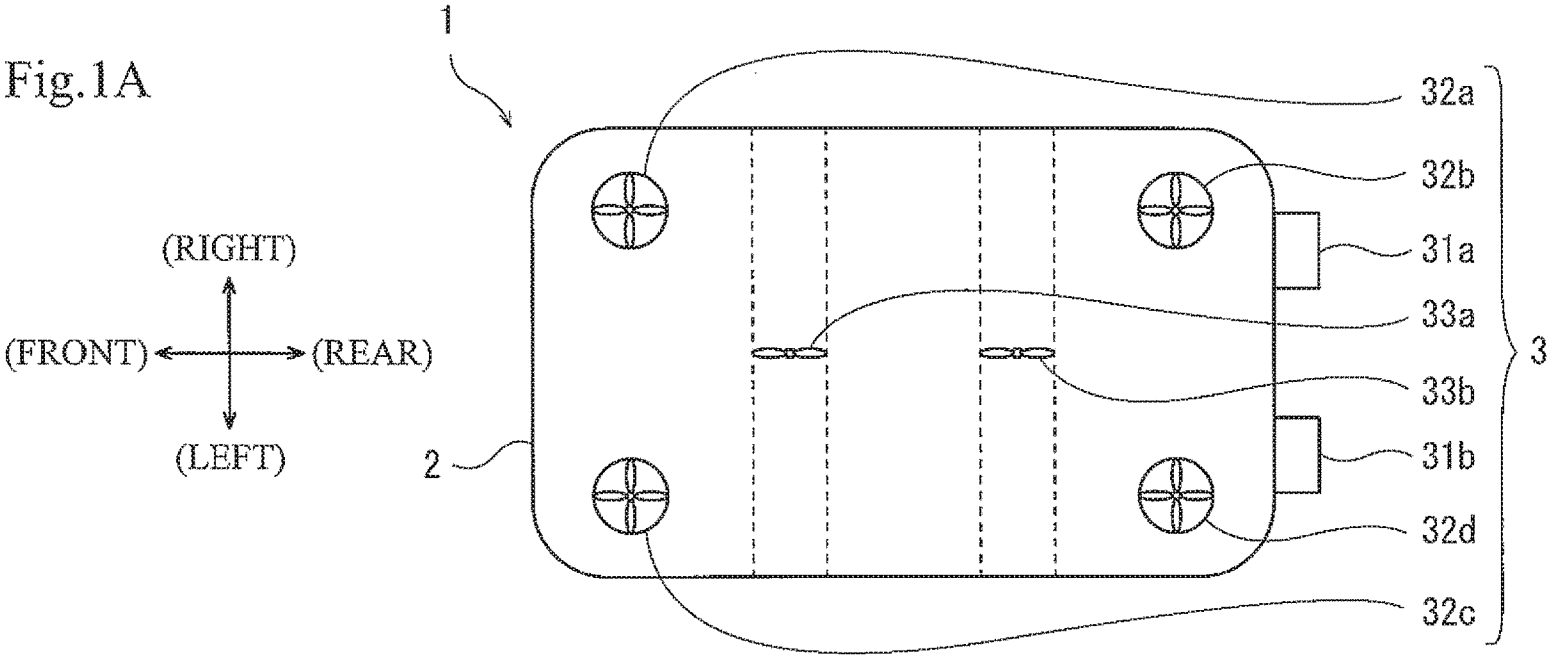
FIGS. 1A and 1B are diagrams each showing one example of actuators included in an underwater sailing body according to Embodiment 1 of the present invention.
Figure 1B:
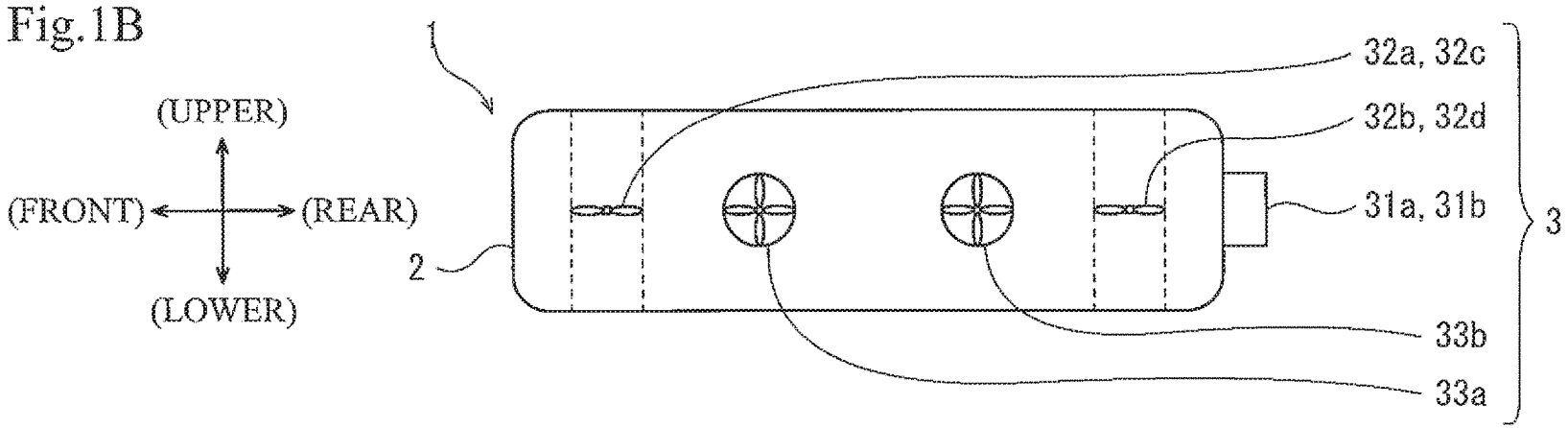

FIGS. 1A and 1B are diagrams each showing one example of actuators 3 included in the underwater sailing body 1 according to Embodiment 1 of the present invention. FIG. 1A is a top view (plan view) of the underwater sailing body 1, and FIG. 1B is a side view of the underwater sailing body 1. For convenience of explanation, FIG. 1 shows only the arrangement of the actuators 3 included in the underwater sailing body 1.

As shown in FIGS. 1A and 1B, the underwater sailing body 1 has a substantially rectangular solid shape formed such that an area of each of upper and lower surfaces of a hull 2 is larger than an area of each of left, right, front, and rear side surfaces of the hull 2. As the actuators 3, the underwater sailing body 1 includes: two main propulsion units 31*a* and 31*b* configured to move the hull 2 in a front-rear direction; four vertical thrusters 32*a*, 32*b*, 32*c*, and 32*d* configured to move the hull 2 in an upper-lower direction; and two horizontal thrusters 33*a* and 33*b* configured to move the hull 2 in a left-right direction. It should be noted that: each of the main propulsion units 31*a* and 31*b* is simply referred to as a main propulsion unit 31 when it is unnecessary to distinguish between the main propulsion units 31*a* and 31*b*; each of the vertical thrusters 32*a*, 32*b*, 32*c*, and 32*d* is simply referred to as a vertical thruster 32 when it is unnecessary to distinguish among the vertical thrusters 32*a*, 32*b*, 32*c*, and 32*d*; and each of the horizontal thrusters 33*a* and 33*b* is referred to as a horizontal thruster 33 when it is unnecessary to distinguish between the horizontal thrusters 33*a* and 33*b*.

As shown in FIG. 1A, in the underwater sailing body 1 of Embodiment 1, the two main propulsion units 31*a* and 31*b* are provided such that rotating shafts of propellers of the main propulsion units 31*a* and 31*b* extend along an axis extending in the front-rear direction of the hull 2. Further, the two horizontal thrusters 33*a* and 33*b* are provided such that rotating shafts of propellers of the horizontal thrusters 33*a* and 33*b* extend along an axis extending in the left-right direction of the hull 2. Furthermore, the four vertical thrusters 32*a*, 32*b*, 32*c*, and 32*d* are provided such that rotating shafts of propellers of the vertical thrusters 32*a*, 32*b*, 32*c*, and 32*d* extend along an axis extending in the upper-lower direction of the hull 2.

The underwater sailing body 1 can move the hull 2 in the front-rear direction by the two main propulsion units 31*a* and 31*b* and can also move the hull 2 in the left-right direction by the two horizontal thrusters 33*a* and 33*b*. The underwater sailing body 1 can control a rotational movement of the hull 2 in a yaw direction by adjusting outputs of the two horizontal thrusters 33*a* and 33*b*. Further, the underwater sailing body 1 can move the hull 2 in the upper-lower direction by the four vertical thrusters 32*a*, 32*b*, 32*c*, and 32*d*. The underwater sailing body 1 can control a rotational movement of the hull 2 in a pitch direction and a rotational movement of the hull 2 in a roll direction by adjusting outputs of the four vertical thrusters 32*a*, 32*b*, 32*c*, and 32*d*.

As shown in FIGS. 1A and 1B, the hull 2 of the underwater sailing body 1 has a substantially rectangular solid shape. However, the present embodiment is not limited to this, and the shape of the hull 2 is suitably selected depending on, for example, a purpose of work performed by the underwater sailing body 1. As described above, as the actuators 3, the underwater sailing body 1 of Embodiment 1 includes the two main propulsion units 31*a* and 31*b*, the four vertical thrusters 32*a*, 32*b*, 32*c*, and 32*d*, and the two horizontal thrusters 33*a* and 33*b*. However, the number of actuators 3 and the types of the actuators 3 are not limited to these.

For example, the underwater sailing body 1 may be configured such that: the rotating shafts of the propellers of the two main propulsion units 31*a* and 31*b* are provided so as to be inclined at an angle of about 45° with respect to a center line (not shown) extending in the front-rear direction of the underwater sailing body 1 and so as to extend to a left-rear side and a right-rear side, respectively; and the movements of the hull 2 in the front-rear direction and the left-right direction and the rotational movement of the hull 2 in the yaw direction are controlled by the main propulsion units 31*a* and 31*b*.

To be specific, the underwater sailing body 1 is only required to be configured such that: the hull 2 can move in the front-rear direction, the left-right direction, and the upper-lower direction; and the posture of the hull 2 can be changed by rotating the hull 2 in the roll direction, the yaw direction, and the pitch direction. Therefore, the number of actuators 3 and the types of the actuators 3 may be determined arbitrarily.

Components and Control Flow for Holding Hull at Target Position

Figure 2:
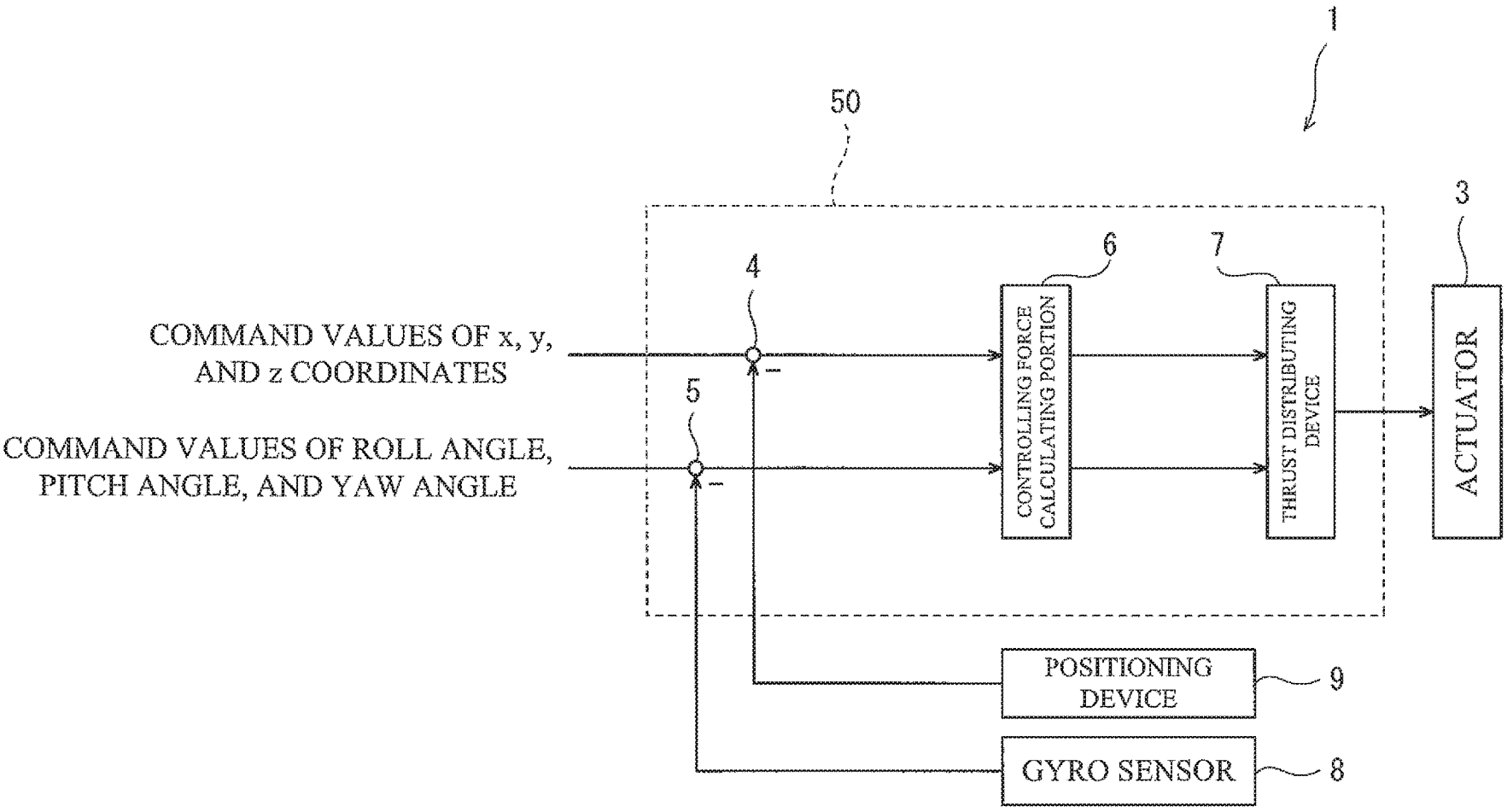
FIG. 2 is a block diagram showing one example of components related to a target position holding operation of the underwater sailing body according to Embodiment 1 of the present invention.

Next, components for holding the hull 2 at a target position by using the actuators 3 will be explained with reference to FIG. 2. FIG. 2 is a block diagram showing one example of components related to a target position holding operation of the underwater sailing body 1 according to Embodiment 1 of the present invention. For convenience of explanation, in FIG. 2, flows of command values of x, y, and z coordinates corresponding to positional information indicating the position of the hull 2 are collectively shown by one arrow. Further, flows of command values of a roll angle, a pitch angle, and a yaw angle corresponding to posture information indicating the posture of the hull 2 are collectively shown by one arrow.

As shown in FIG. 2, the underwater sailing body 1 includes a gyro sensor 8, a positioning device 9, and a controller 50 in addition to the actuators 3.

The gyro sensor 8 is one example of a posture detecting sensor of the present invention and detects the posture information indicating the posture of the hull 2. The positioning device 9 detects the positional information indicating the position of the hull 2. It should be noted that a publicly known acoustic positioning device configured to use ultrasound to measure a relative position of the hull 2 from a mother ship or a predetermined position on the seabed as a reference point can be utilized as the positioning device 9.

The controller 50 performs various control operations of the underwater sailing body 1 and includes a first comparing portion 4, a second comparing portion 5, a controlling force calculating portion 6, and a thrust distributing device 7. The first comparing portion 4 calculates a difference between the command value of the x coordinate as a target value and the command value of the measured x coordinate, a difference between the command value of the y coordinate as a target value and the command value of the measured y coordinate, and a difference between the command value of the z coordinate as a target value and the command value of the measured z coordinate. It should be noted that the underwater sailing body 1 includes first comparing portions 4*a*, 4*b*, and 4*c* for the respective command values of the x, y, and z coordinates (see FIG. 7 described below). However, each of the first comparing portions 4*a*, 4*b*, and 4*c* is referred to as the first comparing portion 4 when it is unnecessary to distinguish among the first comparing portions 4*a*, 4*b*, and 4*c*. Further, the second comparing portion 5 calculates a difference between the command value of the roll angle as a target value and the command value of the measured roll angle, a difference between the command value of the pitch angle as a target value and the command value of the measured pitch angle, and a difference between the command value of the yaw angle as a target value and the command value of the measured yaw angle. It should be noted that the underwater sailing body 1 includes second comparing portions 5*a*, 5*b*, and 5*c* for the roll angle, the pitch angle, and the yaw angle, respectively (see FIG. 7 described below). However, each of the second comparing portions 5*a*, 5*b*, and 5*c* is simply referred to as the second comparing portion 5 when it is unnecessary to distinguish among the second comparing portions 5*a*, 5*b*, and 5*c*.

From a difference between the target position at which the hull 2 is held and the actual position of the hull 2 and a difference between the target posture of the hull 2 and the actual posture of the hull 2, the controlling force calculating portion 6 calculates: a front-rear controlling force that is a controlling force in the front-rear direction in the underwater sailing body 1; a left-right controlling force that is a controlling force in the left-right direction in the underwater sailing body 1; an upper-lower controlling force that is a controlling force in the upper-lower direction in the underwater sailing body 1; a roll turn controlling force that is a turn controlling force in the roll direction in the underwater sailing body 1; a pitch turn controlling force that is a turn controlling force in the pitch direction in the underwater sailing body 1; and a yaw turn controlling force that is a turn controlling force in the yaw direction in the underwater sailing body 1.

Based on the calculation results of the controlling force calculating portion 6, the thrust distributing device 7 calculates the thrust distributed to the respective actuators 3. Then, the thrust distributing device 7 calculates operation amounts of the actuators 3 from the calculated thrust and outputs the command values corresponding to the calculated operation amounts to the actuators 3. More specifically, the thrust distributing device 7 calculates the pitch angles, the rotational frequencies, and the like of the propellers (not shown) of the main propulsion units 31, the horizontal thrusters 33, and the vertical thrusters 32 constituting the actuators 3 and outputs the command values of the pitch angles, the rotational frequencies, and the like.

According to the underwater sailing body 1 configured as above, the hull 2 can be held at the target position by the following control flow. To be specific, first, a ship operator inputs as the target values to the underwater sailing body 1 (i) the command values indicating the position at which the hull 2 is held, by values of x-, y-, and z-axes of an earth fixed coordinate system and (ii) the command values of the roll angle, the pitch angle, and the yaw angle which define the posture of the underwater sailing body 1. The first comparing portion 4 calculates the difference between the value of the x-axis indicating the actual position of the hull 2 and obtained from the positioning device 9 and the value of the x-axis as the target value, the difference between the value of the y-axis indicating the actual position of the hull 2 and obtained from the positioning device 9 and the value of the y-axis as the target value, and the difference between the value of the z-axis indicating the actual position of the hull 2 and obtained from the positioning device 9 and the value of the z-axis as the target value, and inputs the differences to the controlling force calculating portion 6. Further, the second comparing portion 5 calculates the difference between the roll angle indicating the actual posture of the hull 2 and obtained from the gyro sensor 8 and the value of the roll angle as the target value, the difference between the pitch angle indicating the actual posture of the hull 2 and obtained from the gyro sensor 8 and the value of the pitch angle as the target value, and the difference between the yaw angle indicating the actual posture of the hull 2 and obtained from the gyro sensor 8 and the value of the yaw angle as the target value, and inputs the differences to the controlling force calculating portion 6.

The controlling force calculating portion 6 calculates the front-rear controlling force, the left-right controlling force, the upper-lower controlling force, the roll turn controlling force, the pitch turn controlling force, and the yaw turn controlling force in the underwater sailing body 1, calculates the command values from the calculation results, and inputs the command values to the thrust distributing device 7. The thrust distributing device 7 calculates the thrust distributed to the respective actuators 3 from the input command values. The thrust distributing device 7 calculates the operation amounts of the actuators 3 from the calculated thrust and outputs the command values indicating the operation amounts to the actuators 3. By executing the above control flow, the underwater sailing body 1 of Embodiment 1 can hold the hull 2 at the target position.

The underwater sailing body 1 of Embodiment 1 is configured such that when disturbances occur in a state where the hull 2 is held at the target position, to suppress the electric power consumption, the hull 2 takes a posture in which a bow of the hull 2 is directed in the direction of an external force generated by the disturbances, i.e., a posture by which a fluid force acting on the hull 2 is reduced. For example, when the external force is applied to the hull 2 from a left-front and diagonally-upper side of the hull 2 as shown in FIGS. 3A, 3B, 4A, and 4B, the front-rear controlling force is applied to the hull 2 in the front direction, the left-right controlling force is applied to the hull 2 in the left direction, and the upper-lower controlling force is applied to the hull 2 in the upper direction. Thus, the hull 2 keeps balance so as to be held at the target position. The bow of the underwater sailing body 1 is directed in the direction in which the external force acts, and the underwater sailing body 1 takes a posture by which each of the left-right controlling force and the upper-lower controlling force becomes zero, in other words, the posture by which the fluid force acting on the hull is reduced.

Figure 3B:
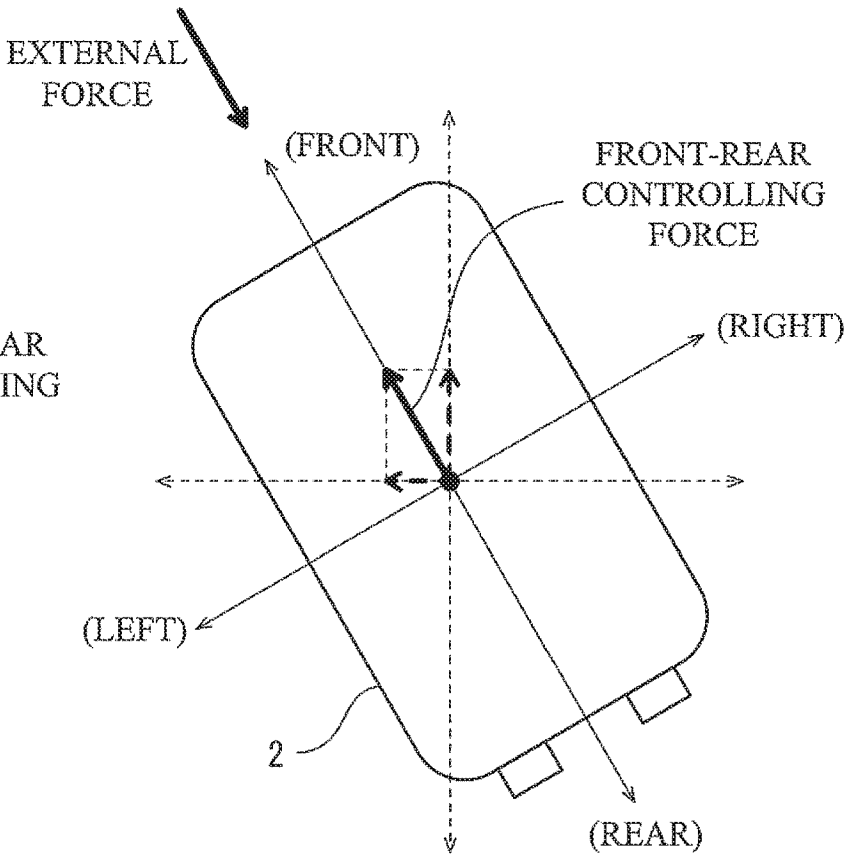
FIGS. 3A and 3B are diagrams each showing one example of a posture of the underwater sailing body of FIG. 2 on a horizontal plane.
Figure 3A:
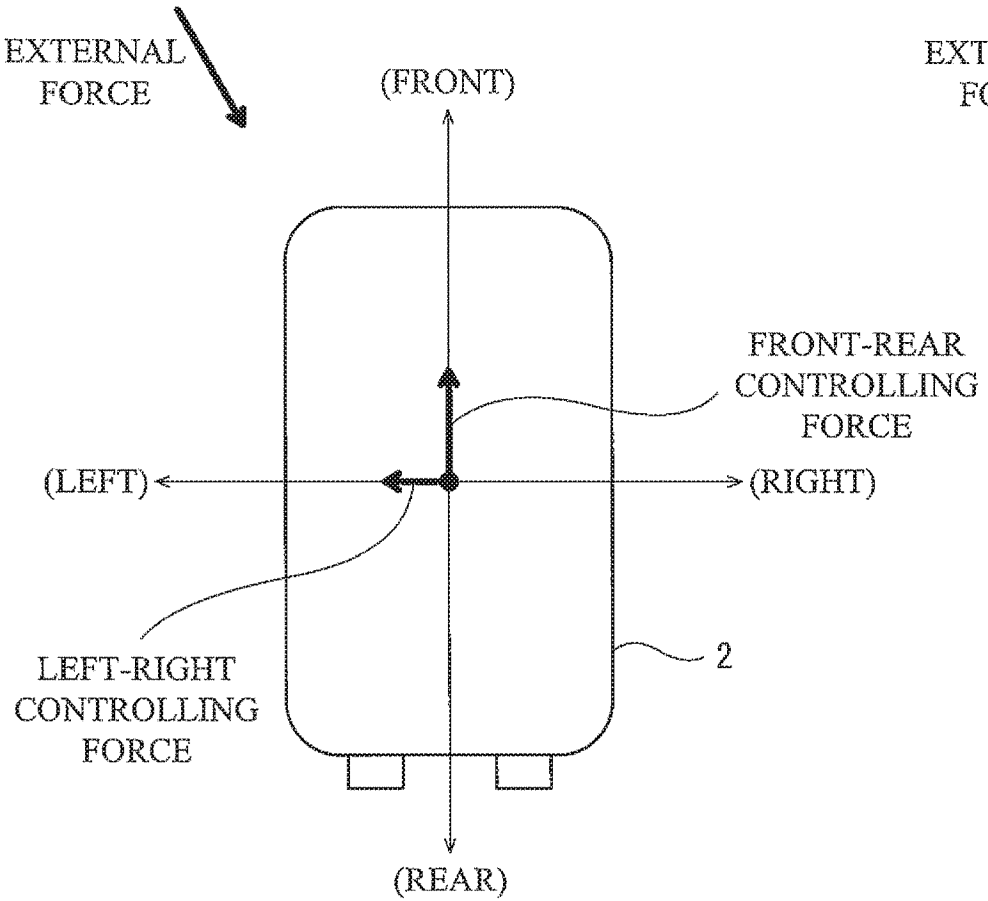
Figure 4A:
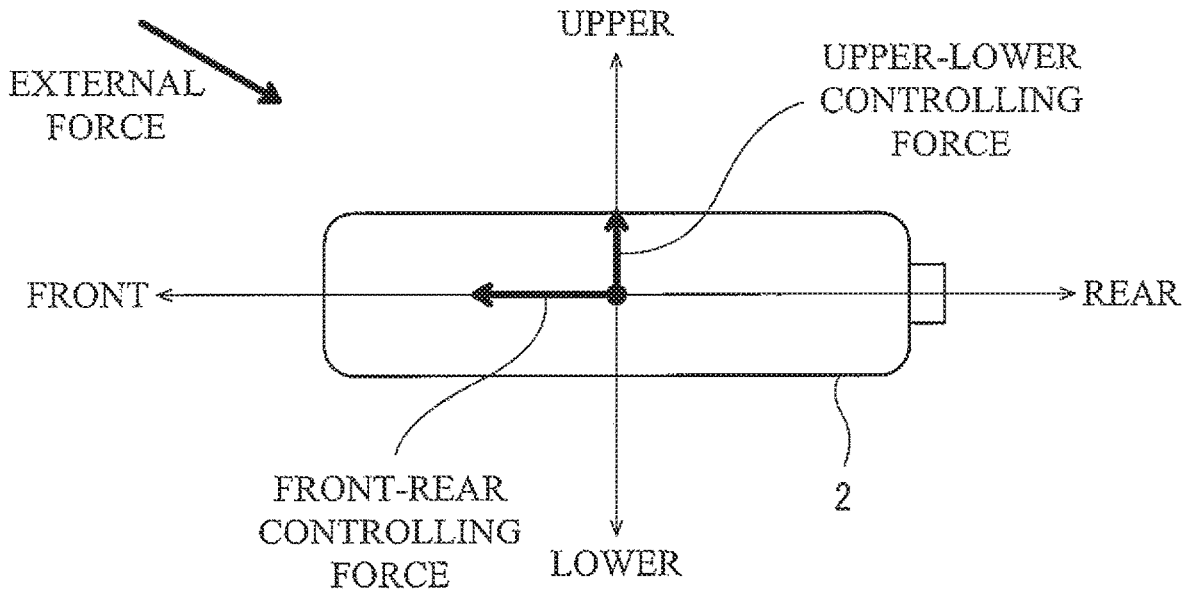
FIGS. 4A and 4B are diagrams each showing one example of the posture of the underwater sailing body of FIG. 2 in a vertical direction.
Figure 4B:
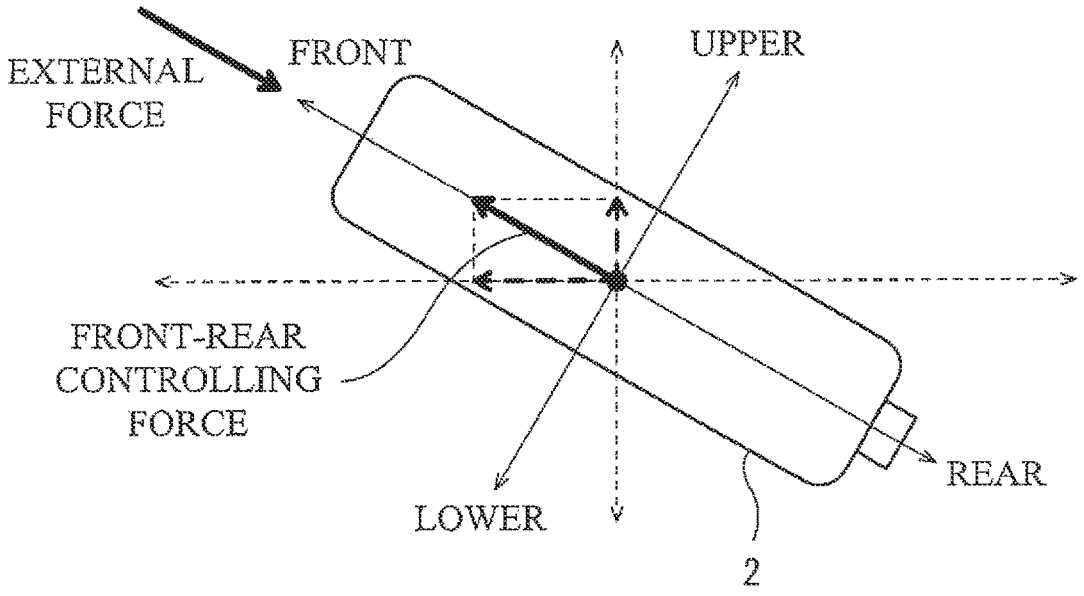

FIGS. 3A and 3B are diagrams each showing one example of the posture of the underwater sailing body 1 of FIG. 2 on a horizontal plane. FIG. 3A shows one example of the posture of the underwater sailing body 1 when disturbances occur. FIG. 3B shows one example of the posture of the underwater sailing body 1 which posture is changed in accordance with the occurrence of the disturbances. FIGS. 4A and 4B are diagrams each showing one example of the posture of the underwater sailing body 1 of FIG. 2 in a vertical direction. FIG. 4A shows one example of the posture of the underwater sailing body 1 when disturbances occur. FIG. 4B shows one example of the posture of the underwater sailing body 1 which posture is changed in accordance with the occurrence of the disturbances.

Control of Posture by Utilizing Measurement Result of Flow Direction Meter

Figure 5:
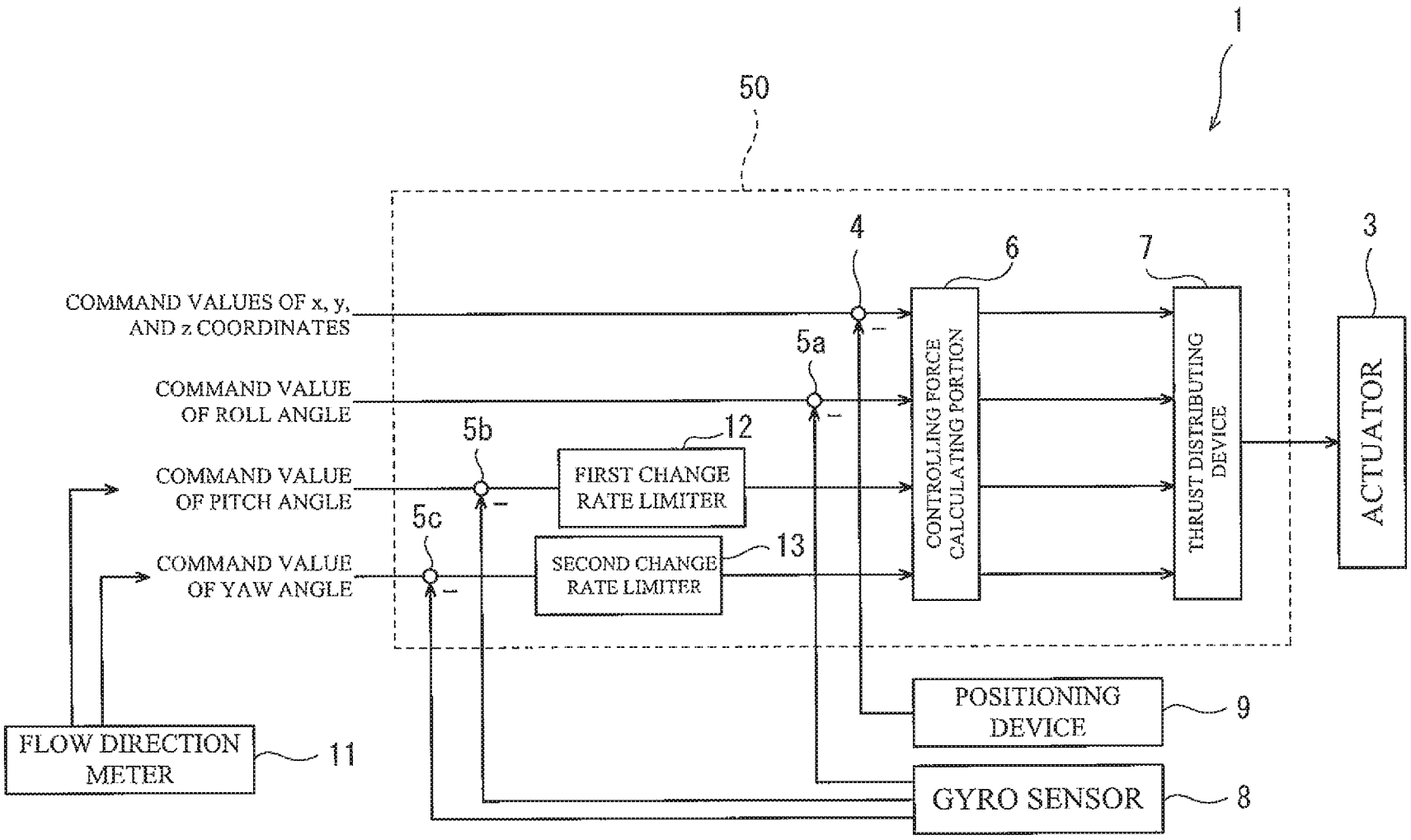
FIG. 5 is a block diagram showing components related to the control of the posture of the underwater sailing body of Embodiment 1 when disturbances occur.

Hereinafter, the control of the posture of the hull 2 of the underwater sailing body 1 of Embodiment 1 when disturbances occur will be explained with reference to FIG. 5. FIG. 5 is a block diagram showing components related to the control of the posture of the underwater sailing body 1 of Embodiment 1 when disturbances occur. In FIG. 5, to more specifically explain the control of the posture of the hull 2, the flows of the command values of the roll angle, the pitch angle, and the yaw angle are shown by separate arrows.

As shown in FIG. 5, as the components related to the control of the posture of the hull 2 when disturbances occur, the underwater sailing body 1 of Embodiment 1 includes a flow direction meter 11, and the controller 50 further includes a first change rate limiter 12 and a second change rate limiter 13.

The flow direction meter 11 is a device configured to measure a tidal current incoming direction. For example, each of the first change rate limiter 12 and the second change rate limiter 13 limits a change amount per second of the calculated command value. In the underwater sailing body 1, the first change rate limiter 12 limits the change amount per second of the command value of the pitch angle, and the second change rate limiter 13 limits the change amount per second of the command value of the yaw angle.

As described above, according to the underwater sailing body 1, the controlling force calculating portion 6 calculates the front-rear controlling force, the left-right controlling force, the upper-lower controlling force, the roll turn controlling force, the pitch turn controlling force, and the yaw turn controlling force in the underwater sailing body 1 based on the difference between the command value ($x_t$) of the x coordinate as the target value and the command value (x) of the x coordinate indicating the measured position of the hull 2, the difference between the command value ($y_t$) of the y coordinate as the target value and the command value (y) of the y coordinate indicating the measured position of the hull 2, the difference between the command value ($z_t$) of the z coordinate as the target value and the command value (z) of the z coordinate indicating the measured position of the hull 2, the difference between the command value ($\varphi_r$) of the roll angle as the target value and the command value ($\varphi$) of the roll angle indicating the measured posture of the hull 2, the difference between the command value ($\theta_t$) of the pitch angle as the target value and the command value ($\theta$) of the pitch angle indicating the measured posture of the hull 2, and the difference between the command value ($\Psi_t$) of the yaw angle as the target value and the command value ($\Psi$) of the yaw angle indicating the measured posture of the hull 2. The thrust distributing device 7 calculates the thrust distributed to the respective actuators 3 based on the calculation results of the controlling force calculating portion 6, calculates the operation amounts of the actuators 3 from the calculated thrust, and controls the actuators 3 based on the operation amounts of the actuators 3 to hold the hull 2 at the target position.

According to this configuration, when the external force is applied to the hull 2, the underwater sailing body 1 turns only in the pitch direction and the yaw direction with respect to the external force to change the posture thereof. Therefore, only the command value of the pitch angle and the command value of the yaw angle are updated by using information indicating the tidal current direction obtained from the flow direction meter 11. Hereinafter, the update of the command value of the pitch angle and the update of the command value of the yaw angle will be explained.

According to the underwater sailing body 1, first, the direction in which the external force acts (tidal current incoming direction) is measured by the flow direction meter 11. The command value ($\theta_t$) of the pitch angle as the target value is updated to the value ($\theta_c$) of the pitch angle of the posture in which the bow is directed in the tidal current incoming direction measured by the flow direction meter 11, and the command value ($\Psi_t$) of the yaw angle as the target value is updated to the value ($\Psi_c$) of the yaw angle of the posture in which the bow is directed in the tidal current incoming direction measured by the flow direction meter 11. The second comparing portion 5*b* calculates a difference ($\theta_c-\theta$) between the updated value ($\theta_c$) of the pitch angle and the command value $\theta$ of the pitch angle measured by the gyro sensor 8, and the second comparing portion 5*c* calculates a difference ($\Psi_c-\Psi$) between the updated value ($\Psi_c$) of the yaw angle and the command value $\Psi$ of the yaw angle measured by the gyro sensor 8. The first change rate limiter 12 applies a change rate limit to the difference regarding the command value of the pitch angle calculated by the second comparing portion 5*b* and inputs the obtained value to the controlling force calculating portion 6. Similarly, the second change rate limiter 13 applies a change rate limit to the difference regarding the command value of the yaw angle calculated by the second comparing portion 5*c* and inputs the obtained value to the controlling force calculating portion 6.

To prevent the posture of the hull 2 from being drastically changed when disturbances occur, the underwater sailing body 1 includes the first change rate limiter 12 and the second change rate limiter 13. However, these members are not necessarily required when, for example, the underwater sailing body 1 is used under such an environment that the change in the posture due to the occurrence of the disturbances is small.

The controlling force calculating portion 6 calculates the pitch turn controlling force from the input value obtained by applying the change rate limit to the difference regarding the command value of the pitch angle. Further, the controlling force calculating portion 6 calculates the yaw turn controlling force from the input value obtained by applying the change rate limit to the difference regarding the command value of the yaw angle. Then, the controlling force calculating portion 6 calculates the command value of the pitch turn controlling force and the command value of the yaw turn controlling force from the above calculation results and inputs these command values to the thrust distributing device 7.

Based on the input command values of the respective turn controlling forces, the thrust distributing device 7 calculates the operation amounts of the actuators 3 such that the hull 2 turns in the pitch direction and the yaw direction. Then, the thrust distributing device 7 outputs the command values corresponding to the calculated operation amounts to the actuators 3. The above control flow is performed until the bow is directed in the direction of the external force applied to the hull 2. As above, the underwater sailing body 1 according to Embodiment 1 can change the posture so as to gradually direct the bow in the direction of the external force while being held at a predetermined position.

Figure 6:
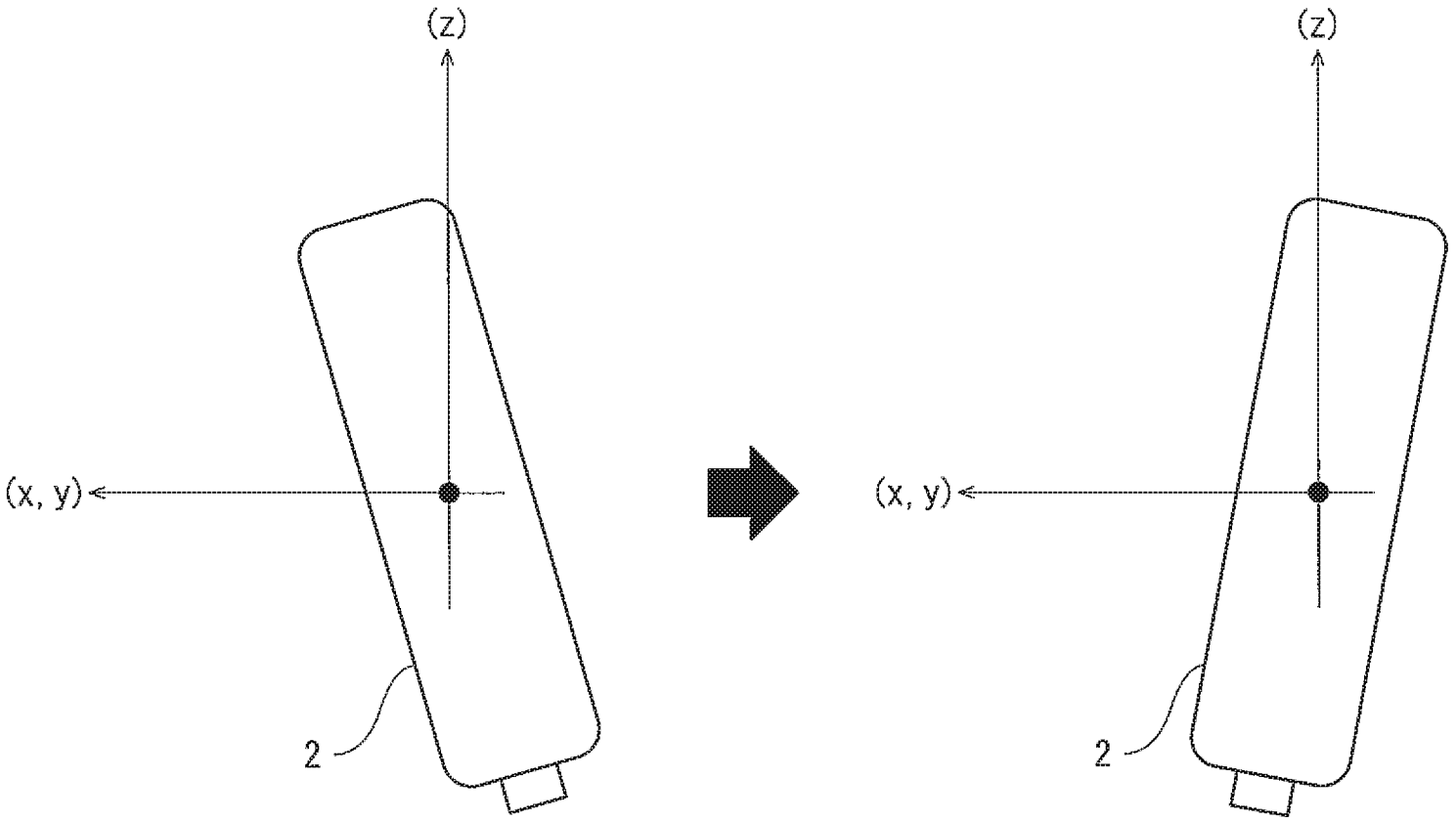
FIG. 6 is a diagram showing one example showing a state where the direction of a bow of the underwater sailing body of Embodiment 1 changes from a front and upper direction to a rear and upper direction.

When the external force is applied to the hull 2 from a rear and diagonally-upper side of the hull 2, as shown in FIG. 6, the hull 2 may move from a state where the bow is directed to a front and diagonally-upper side to a state where the pitch angle of the hull 2 exceeds 90°, and the bow is directed to a rear side. FIG. 6 is a diagram showing one example of a state where the direction of the bow of the underwater sailing body 1 of Embodiment 1 changes from a front and upper direction to a rear and upper direction. In FIG. 6, the horizontal plane corresponds to an x-y plane, and the vertical direction corresponds to the z-axis direction.

In this case, the hull 2 of the underwater sailing body 1 takes an abnormal posture, i.e., is turned upside down, and this is not preferable for the control of the underwater sailing body 1 and predetermined work performed by the underwater sailing body 1. As shown in FIG. 6, when the bow turns by an angle of 2° in the pitch direction from the posture (for example, (pitch, yaw)=(89°, 0°)) in which the bow is directed in the front and upper direction, to be directed in the rear and upper direction, the posture after this turn is represented by "(pitch, yaw)=(89°, 180°)." As above, a problem may arise, in which regarding an azimuth angle indicating the posture, the yaw discontinuously changes from 0° to 180°, and this causes instability of control.

To prevent the posture of the hull 2 from changing as shown in FIG. 6, the underwater sailing body 1 may be configured such that the posture in the yaw direction is preferentially changed, and the posture in the pitch direction is then changed.

Specifically, according to the underwater sailing body 1, when the external force is applied to the hull 2, first, the first change rate limiter 12 sets the change amount in the pitch direction to zero, and the turn is performed only in the yaw direction. After the turn in the yaw direction, the second change rate limiter 13 sets the change amount in the yaw direction to zero, and the first change rate limiter returns the change amount, which is zero, to the initial value. Then, the turn is performed in the pitch direction.

Or, to prevent the posture of the hull 2 from changing as shown in FIG. 6, the underwater sailing body 1 according to Embodiment 1 may be configured such that a speed of updating the pitch angle to the target value is lower than a speed of updating the yaw angle to the target value. Specifically, in the underwater sailing body 1, change rates are set such that the change amount of the first change rate limiter 12 is smaller than the change amount of the second change rate limiter 13.

As above, the underwater sailing body 1 according to Embodiment 1 may be configured such that the turn of the hull 2 in the yaw direction is performed preferentially over the turn of the hull 2 in the pitch direction. Therefore, the hull 2 can be prevented from taking the abnormal posture, and the unstable control before and after the abnormal posture can be avoided.

Embodiment 2

Control of Posture Without Flow Direction Meter

Figure 7:
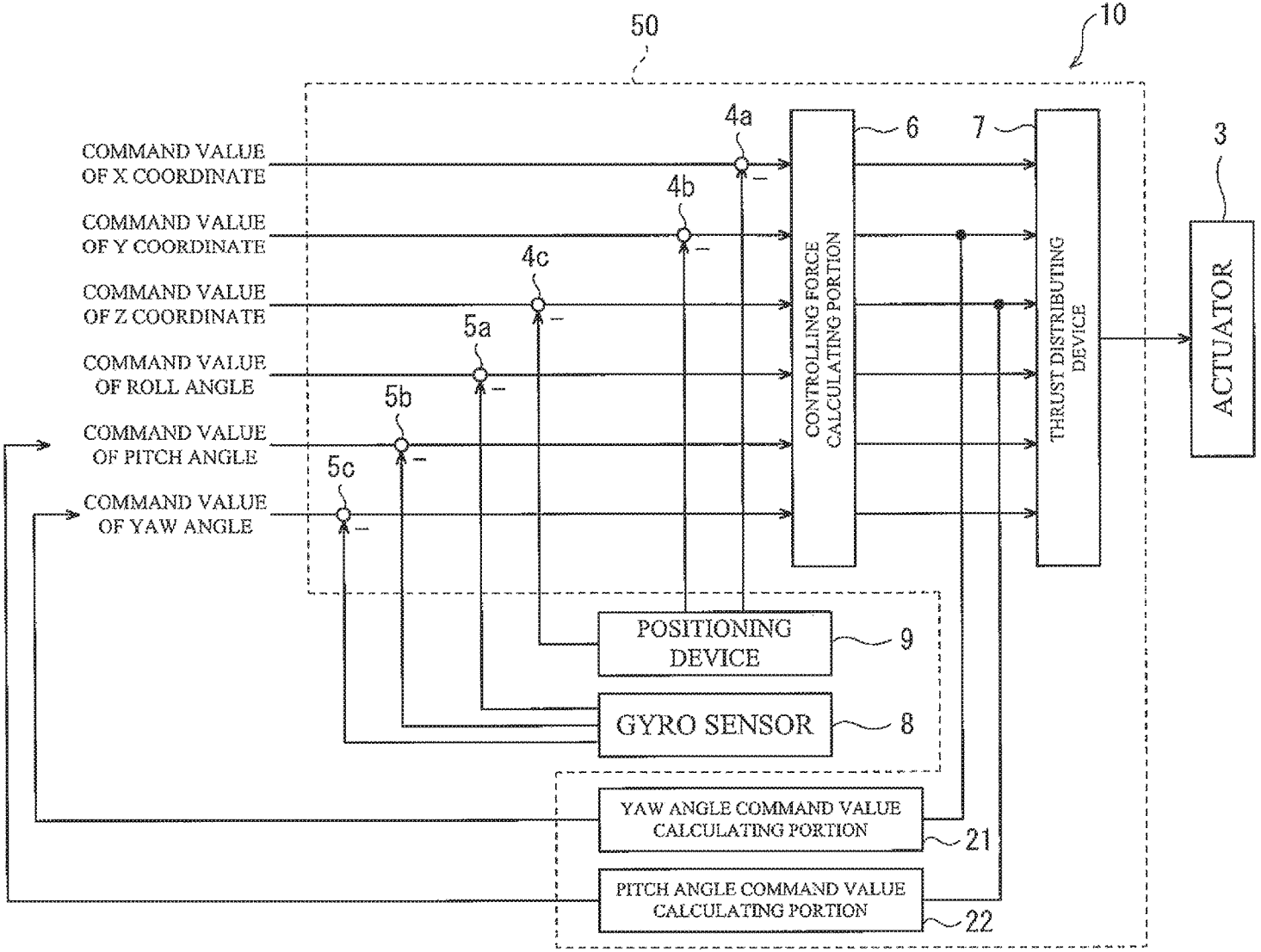
FIG. 7 is a block diagram showing components related to the control of the posture of the underwater sailing body of Embodiment 2 when disturbances occur.

The control of the posture of an underwater sailing body 10 of Embodiment 2 when disturbances occur will be explained with reference to FIG. 7. The underwater sailing body 10 does not include the flow direction meter 11. FIG. 7 is a block diagram showing components related to the control of the posture of the underwater sailing body 10 of Embodiment 2 when disturbances occur. As shown in FIG. 7, the underwater sailing body 10 of Embodiment 2 is different from the underwater sailing body 1 of Embodiment 1 in that: the underwater sailing body 10 of Embodiment 2 does not include the flow direction meter 11; and the controller 50 of Embodiment 2 does not include the first change rate limiter 12 and the second change rate limiter 13 but includes a yaw angle command value calculating portion 21 and a pitch angle command value calculating portion 22. Other than the above, the underwater sailing body 10 of Embodiment 2 is the same in configuration as the underwater sailing body 1 of Embodiment 1. Therefore, the same reference signs are used for the same members, and a repetition of the same explanation is avoided.

Although details will be described later, the yaw angle command value calculating portion 21 calculates the yaw angle command value as the target value and includes an integrator configured to integrate the command value of the left-right controlling force output from the controlling force calculating portion 6. Further, the pitch angle command value calculating portion 22 calculates the pitch angle command value as the target value and includes an integrator configured to integrate the command value of the upper-lower controlling force output from the controlling force calculating portion 6.

Since the flow direction meter 11 is not included, the underwater sailing body 10 cannot directly recognize the tidal current incoming direction (direction in which the external force acts). Therefore, the underwater sailing body 10 is configured such that: the command value of the yaw angle is calculated from the left-right controlling force that acts to hold the hull 2 at the predetermined position when the external force is applied to the hull 2; and the command value of the pitch angle is calculated from the upper-lower controlling force that acts to hold the hull 2 at the predetermined position when the external force is applied to the hull 2.

For example, as shown in FIGS. 3A, 3B, 4A, and 4B, when the external force is applied to the hull 2 from a left-front and diagonally-upper side, the hull 2 is controlled so as to turn and stop at a position where the direction of the external force and the bow face each other, in other words, as shown in FIGS. 3B and 4B, a position where the left-right controlling force is zero, and the upper-lower controlling force is zero. For example, when the external force is applied to a port side of the hull 2 as shown in FIG. 3A, the left-right controlling force acts in the left direction to hold the hull 2 at the target position. In contrast, when the external force is applied to a starboard side of the hull 2, the left-right controlling force acts in the right direction to hold the hull 2 at the target position. When the external force is applied to an upper side of the hull 2 as shown in FIG. 4A, the upper-lower controlling force acts in the upper direction. In contrast, when the external force is applied to a lower side of the hull 2, the upper-lower controlling force acts in the lower direction. Therefore, a turning direction of the hull 2 is determined based on acting directions of the left-right controlling force and the upper-lower controlling force, and the command value of the pitch angle and the command value of the yaw angle are updated on the basis that the direction of the bow in the posture in which each of the left-right controlling force and the upper-lower controlling force is zero is the direction in which the external force acts.

Specifically, by the following control flow, the underwater sailing body 10 of Embodiment 2 controls the posture of the hull 2 held at the target position. First, as with the underwater sailing body 1 of Embodiment 1, according to the underwater sailing body 10, the controlling force calculating portion 6 calculates the front-rear controlling force, the left-right controlling force, the upper-lower controlling force, the roll turn controlling force, the pitch turn controlling force, and the yaw turn controlling force in the underwater sailing body 10 based on the difference between the command value ($x_t$) of the x coordinate as the target value and the command value (x) of the x coordinate indicating the measured position of the hull 2, the difference between the command value ($y_t$) of the y coordinate as the target value and the command value (y) of the y coordinate indicating the measured position of the hull 2, the difference between the command value ($z_t$) of the z coordinate as the target value and the command value (z) of the z coordinate indicating the measured position of the hull 2, the difference between the command value ($\varphi_t$) of the roll angle as the target value and the command value ($\varphi$) of the roll angle indicating the measured posture of the hull 2, the difference between the command value ($\theta_t$) of the pitch angle as the target value and the command value ($\theta$) of the pitch angle indicating the measured posture of the hull 2, and the difference between the command value ($\Psi_r$) of the yaw angle as the target value and the command value ($\Psi$) of the yaw angle indicating the measured posture of the hull 2. Then, the thrust distributing device 7 calculates the thrust distributed to the respective actuators 3 based on the calculation results of the controlling force calculating portion 6, calculates the operation amounts of the actuators 3 from the calculated thrust, and controls the actuators 3 to hold the hull 2 at the target position. According to this configuration, when the external force is applied to the hull 2, the underwater sailing body 10 of Embodiment 2 changes the posture of the hull 2 in the following manner.

To be specific, according to the underwater sailing body 10, the command value of the controlling force acting in the left-right direction to hold the hull 2 at the target position when disturbances occur is input to the yaw angle command value calculating portion 21, and the command value of the controlling force acting in the upper-lower direction to hold the hull 2 at the target position when disturbances occur is input to the pitch angle command value calculating portion 22. The yaw angle command value calculating portion 21 calculates the yaw angle command value $\Psi_t$ from a value obtained by integrating a value obtained by multiplying the input command value of the left-right controlling force by a gain, and updates the yaw angle command value $\Psi_t$ as the target value to the calculated yaw angle command value $\Psi_r$.

The pitch angle command value calculating portion 22 calculates the pitch angle command value $\theta_t$ from a value obtained by integrating a value obtained by multiplying the input command value of the upper-lower controlling force by a gain, and updates the pitch angle command value $\theta_t$ as the target value to the calculated pitch angle command value $\theta_r$. As above, the yaw angle command value calculating portion 21 determines an azimuth of the yaw angle as a target from a value obtained by integrating the command value of the left-right controlling force. Further, the pitch angle command value calculating portion 22 determines an azimuth of the pitch angle as a target from a value obtained by integrating the command value of the upper-lower controlling force.

The yaw angle command value $\Psi_t$ as the updated target value is compared by the second comparing portion 5*c* with the actual yaw angle command value $\Psi$ measured by the gyro sensor 8, and the difference therebetween is input to the controlling force calculating portion 6. Further, the updated pitch angle command value $\theta_r$ is compared by the second comparing portion 5*b* with the actual pitch angle command value $\theta$ measured by the gyro sensor 8, and the difference therebetween is input to the controlling force calculating portion 6.

The controlling force calculating portion 6 calculates the pitch turn controlling force from the above difference regarding the pitch angle command value and also calculates the yaw turn controlling force from the above difference regarding the yaw angle command value. Then, the controlling force calculating portion 6 inputs the command values of the respective turn controlling forces, calculated from the calculation result, to the thrust distributing device 7. Based on the input command values of the respective turn controlling forces, the thrust distributing device 7 calculates the operation amounts of the actuators 3 for turning the hull 2 in the pitch direction and the yaw direction and outputs the command values of the calculated operation amounts to the actuators 3. The update of the target value of the yaw angle command value is performed until the left-right controlling force becomes zero, and the update of the target value of the pitch angle command value is performed until the upper-lower controlling force becomes zero. Thus, the underwater sailing body 10 of Embodiment 2 can change the posture thereof so as to direct the bow in the direction of the external force with the hull 2 held at the predetermined position.

According to the underwater sailing body 10 of Embodiment 2, as with the underwater sailing body 1 of Embodiment 1, the pitch angle of the hull 2 may exceed 90°, and the underwater sailing body 10 may take the abnormal posture. To prevent the underwater sailing body 10 from taking the abnormal posture, the underwater sailing body 10 may be configured as below.

To be specific, according to the underwater sailing body 10, when the external force is applied to the hull 2, first, the pitch angle command value calculating portion 22 sets the value of the gain, by which the command value of the upper-lower controlling force is multiplied, to zero, and the turn is performed only in the yaw direction. After the turn in the yaw direction, the yaw angle command value calculating portion 21 sets the value of the gain, by which the command value of the left-right controlling force is multiplied, to zero, and the pitch angle command value calculating portion 22 returns the value of the gain, which is zero, to the initial value. Then, the turn is performed in the pitch direction.

Or, to prevent the hull 2 from taking the abnormal posture, the underwater sailing body 10 may be configured such that the speed of updating the target value of the pitch angle is lower than the speed of updating the target value of the yaw angle. Specifically, in the underwater sailing body 10, the value of the gain by which the pitch angle command value calculating portion 22 multiplies the command value of the upper-lower controlling force is set to be smaller than the value of the gain by which the yaw angle command value calculating portion 21 multiplies the command value of the left-right controlling force.

As above, the underwater sailing body 10 according to Embodiment 2 is configured such that the turn of the hull 2 in the yaw direction is performed preferentially over the turn of the hull 2 in the pitch direction. Therefore, the hull 2 can be prevented from taking the abnormal posture, and the unstable control before and after the abnormal posture can be avoided.

Modified Example

Figure 8:
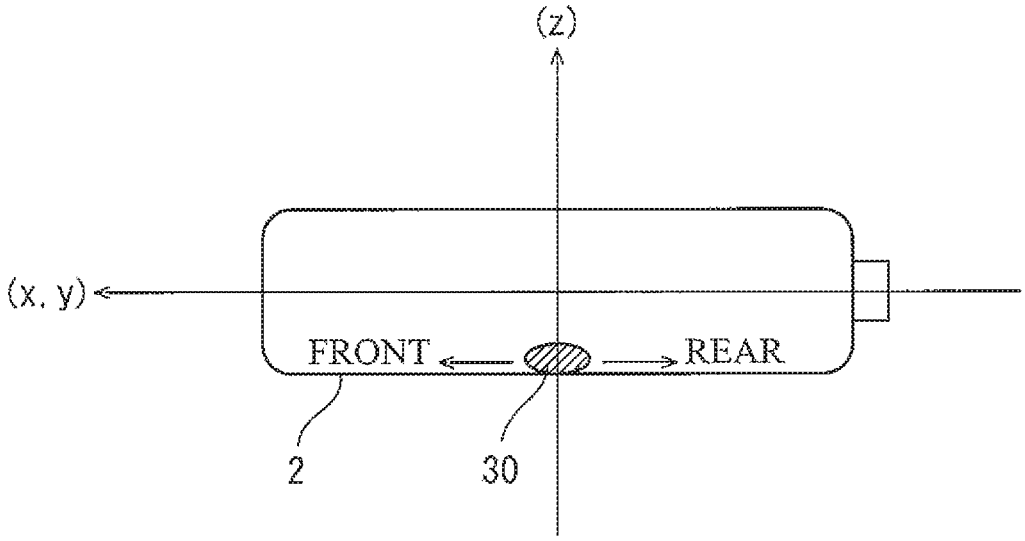
FIG. 8 is a diagram schematically showing one example of the configuration of a modified example of the underwater sailing body.

Each of the underwater sailing body 1 of Embodiment 1 and the underwater sailing body 10 of Embodiment 2 is configured to control a rotational direction of pitching of the hull 2 by operating a plurality of vertical thrusters 32. However, as shown in FIG. 8, the underwater sailing body may be configured such that: a gravity center position changing portion 30 configured to be movable in the front-rear direction is included as the actuator 3; and the inclination of the hull 2 in the upper-lower direction, i.e., the rotational direction of the pitching of the hull 2 is controlled by changing the gravity center position of the hull 2. FIG. 8 is a diagram schematically showing one example of the configuration of a modified example of the underwater sailing body 1, 10. FIG. 8 schematically shows the structure of a cross section of the underwater sailing body 1, 10, the cross section being taken vertically in the front-rear direction.

The gravity center position changing portion 30 may be a weight made of metal, such as lead, or may be an air tank. To be specific, the gravity center position changing portion 30 is only required to be able to change the gravity center position of the underwater sailing body 1, 10 in the front-rear direction by moving in the hull 2 in the front-rear direction. As above, when the underwater sailing body 1, 10 includes the gravity center position changing portion 30, the rotational direction of the pitching of the hull 2 can be determined by the movement of the gravity center position changing portion 30, and therefore, the control of the turn in the pitch direction by the vertical thrusters 32 can be facilitated.

From the foregoing explanation, many modifications and other embodiments of the present invention are obvious to one skilled in the art. Therefore, the foregoing explanation should be interpreted only as an example and is provided for the purpose of teaching the best mode for carrying out the present invention to one skilled in the art. The structures and/or functional details may be substantially modified within the scope of the present invention.

INDUSTRIAL APPLICABILITY

The present invention is useful for underwater sailing bodies, such as AUVs, each of which needs to perform work while holding a hull at a target position in water or needs to hold a hull at a target position before performing work.

REFERENCE SIGNS LIST

1 underwater sailing body
2 hull
3 actuator
4 first comparing portion
4*a* first comparing portion
4*b* first comparing portion
4*c* first comparing portion
5 second comparing portion
5*a* second comparing portion
5*b* second comparing portion
5*c* second comparing portion
6 controlling force calculating portion
7 thrust distributing device
8 gyro sensor
9 positioning device
10 underwater sailing body
11 flow direction meter
12 first change rate limiter
13 second change rate limiter
21 yaw angle command value calculating portion
22 pitch angle command value calculating portion
30 gravity center position changing portion
50 controller

The invention claimed is:

1. An underwater sailing body comprising:

a positioning device configured to detect positional information indicating a position of a hull of the underwater sailing body;

a posture detecting sensor configured to detect posture information indicating a posture of the hull;

an actuator configured to apply thrust to the hull in a front-rear direction of the hull, a left-right direction of the hull, and an upper-lower direction of the hull in water to change the position and posture of the hull; and a controller configured to control the actuator, wherein:

in order to hold the hull at a target position based on the positional information detected by the positioning device, the controller calculates a controlling force in the front-rear direction of the hull, a controlling force in the left-right direction of the hull, a controlling force in the upper-lower direction of the hull, a turn controlling force of turning the hull in a roll direction of the hull, a turn controlling force of turning the hull in a yaw direction of the hull, and a turn controlling force of turning the hull in a pitch direction of the hull, and controls the actuator based on the calculated forces, when an external force is applied to the hull held at the target position, the controller updates target posture information such that each of the controlling force in the left-right direction and the controlling force in the upper-lower direction becomes zero, and controls the actuator such that the posture of the hull is changed to a posture corresponding to the updated posture information based on the posture information detected by the posture detecting sensor, the controller includes a controlling force calculating portion configured to calculate the controlling force in the front-rear direction, the controlling force in the left-right direction, the controlling force in the upper-lower direction, the turn controlling force in the roll direction, the turn controlling force in the yaw direction, and the turn controlling force in the pitch direction from a difference between target positional information and the positional information detected by the positioning device and a difference between the target posture information and the posture information detected by the posture detecting sensor, when the external force is applied to the hull held at the target position, the controller updates a command value of a yaw angle of the target posture information and a command value of a pitch angle of the target posture information such that each of the controlling force in the left-right direction and the controlling force in the upper-lower direction, which are calculated by the controlling force calculating portion, becomes zero, the controller includes:

a yaw angle command value calculating portion configured to integrate a value of the controlling force in the left-right direction to calculate a target command value of the yaw angle; and a pitch angle command value calculating portion configured to integrate a value of the controlling force in the upper-lower direction to calculate a target command value of the pitch angle, until each of the controlling force in the left-right direction and the controlling force in the upper-lower direction becomes zero, the controller updates the command value of the yaw angle and the command value of the pitch angle by the command value calculated by the yaw angle command value calculating portion and the command value calculated by the pitch angle command value calculating portion, the yaw angle command value calculating portion calculates the target command value of the yaw angle from a value obtained by integrating a value obtained by multiplying the value of the controlling force in the left-right direction by a gain, the pitch angle command value calculating portion calculates the target command value of the pitch angle from a value obtained by integrating a value obtained by multiplying the value of the controlling force in the upper-lower direction by a gain, and the controller changes a value of the gain by which the yaw angle command value calculating portion multiplies the value of the controlling force in the left-right direction and a value of the gain by which the pitch angle command value calculating portion multiplies the value of the controlling force in the upper-lower direction, and updates the command value of the yaw angle and the command value of the pitch angle in this order, or the controller sets a speed of updating the command value of the pitch angle to be lower than a speed of updating the command value of the yaw angle.

2. The underwater sailing body according to claim 1, wherein the actuator includes a gravity center position changing portion configured to move in the front-rear direction in the hull so as to change a gravity center position of the hull.

3. A method of controlling a posture of an underwater sailing body, the underwater sailing body comprising:

a positioning device configured to detect positional information indicating a position of a hull of the underwater sailing body;

a posture detecting sensor configured to detect posture information indicating a posture of the hull;

an actuator configured to apply thrust to the hull in a front-rear direction of the hull, a left-right direction of the hull, and an upper-lower direction of the hull in water to change the position and posture of the hull; and a controller configured to control the actuator, the method comprising:

in order to hold the hull at a target position based on the positional information detected by the positioning device, calculating by the controller a controlling force in the front-rear direction of the hull, a controlling force in the left-right direction of the hull, a controlling force in the upper-lower direction of the hull, a turn controlling force of turning the hull in a roll direction of the hull, a turn controlling force of turning the hull in a yaw direction of the hull, and a turn controlling force of turning the hull in a pitch direction of the hull, and controlling the actuator by the controller based on the calculated and forces;

when an external force is applied to the hull held at the target position, updating, by the controller, target posture information such that each of the controlling force in the left-right direction and the controlling force in the upper-lower direction becomes zero, and controlling the actuator by the controller such that the posture of the hull is changed to a posture corresponding to the updated posture information based on the posture information detected by the posture detecting sensor;

calculating the controlling force in the front-rear direction, the controlling force in the left-right direction, the controlling force in the upper-lower direction, the turn controlling force in the roll direction, the turn controlling force in the yaw direction, and the turn controlling force in the pitch direction from a difference between target positional information and the positional information detected by the positioning device and a difference between the target posture information and the posture information detected by the posture detecting sensor;

when the external force is applied to the hull held at the target position, updating, by the controller, a command value of a yaw angle of the target posture information and a command value of a pitch angle of the target posture information such that each of the controlling force in the left-right direction and the controlling force in the upper-lower direction, which are calculated by the step of calculating the controlling forces, becomes zero;

integrating a value of the controlling force in the left-right direction to calculate a target command value of the yaw angle;

integrating a value of the controlling force in the upper-lower direction to calculate a target command value of the pitch angle; and until each of the controlling force in the left-right direction and the controlling force in the upper-lower direction becomes zero, updating, by the controller, the command value of the yaw angle and the command value of the pitch angle by the command value calculated by the step of calculating the target command value of the yaw angle and the command value calculated by the step of calculating the target command value of the pitch angle, wherein the target command value of the yaw angle is calculated from a value obtained by integrating a value obtained by multiplying the value of the controlling force in the left-right direction by a gain, wherein the target command value of the pitch angle is calculated from a value obtained by integrating a value obtained by multiplying the value of the controlling force in the upper-lower direction by a gain, and wherein the method further includes changing a value of the gain by which the value of the controlling force in the left-right direction is multiplied and a value of the gain by which the value of the controlling force in the upper-lower direction is multiplied, and updating the command value of the yaw angle and the command value of the pitch angle in this order, or setting a speed of updating the command value of the pitch angle to be lower than a speed of updating the command value of the yaw angle.

* * * * *